US006123040A

United States Patent [19]

Hayakawa et al.

[11] Patent Number: 6,123,040

[45] Date of Patent: Sep. 26, 2000

[54] SEWING MACHINE CAPABLE OF CHANGING A NEEDLE POSITION

[75] Inventors: Akira Hayakawa; Shintaro Tomita, both of Nagoya, Japan

[73] Assignee: Brother Kogyo Kabushiki Kaisha, Nagoya, Japan

[21] Appl. No.: 09/441,521

[22] Filed: Nov. 17, 1999

[30] Foreign Application Priority Data

Nov. 17, 1998 [JP] Japan ..... 10-326707

[51] Int. Cl.[7] ..... D05B 3/02

[52] U.S. Cl. ..... 112/445; 112/456; 112/458

[58] Field of Search ..... 112/456, 445, 112/458, 453, 457, 235, 470.01, 470.07

[56] References Cited

U.S. PATENT DOCUMENTS 4,280,423 7/1981 Goncharko ..... 112/445
4,827,858 5/1989 Horie et al. ..... 112/456
4,862,816 9/1989 Hanyu et al. ..... 112/456
4,876,977 10/1989 Ando et al. .
4,942,836 7/1990 Sano et al. ..... 112/445

*Primary Examiner*—Peter Nerbun
*Attorney, Agent, or Firm*—Oliff & Berridge, PLC.

[57] ABSTRACT

A sewing machine of the invention stores width dimensions and the reference needle penetration position dimensions, which all can be changed for writing and reading, according to the type of presser foot, in a memory. Based on the needle penetration position and the reference needle penetration position which are determined when the seam allowance width is set, the sewing machine calculates a distance between the left or right end of the presser foot and the position where stitches are made, and shows it on the display as the seam allowance width. Therefore, sewing can be made regarding the distance from the left or right end of the presser foot to the place where stitching is made as a seam allowance width, just by aligning the edge of the work cloth with the left or right end of the presser foot.

17 Claims, 13 Drawing Sheets

25A

| PRESSER FOOT TYPE | WIDTH Fw (mm) | REFERENCE NEEDLE PENETRATION POSITION DIMENSIONS A | DISPLAY MODE FLAG F |
|---|---|---|---|
| J | 17 | HALF | 1 OR 0 |
| G | 18 | HALF | |
| A | 20 | HALF | |
| R | 15 | HALF | |

SEWING MACHINE CAPABLE OF CHANGING A NEEDLE POSITION

BACKGROUND OF THE INVENTION

1. Field of Invention

The invention relates to a sewing machine capable of changing a needle position and, in particular, to a sewing machine where a desired seam allowance width can be set and indicated on the display.

2. Description of Related Art

In conventional electronic controlled zigzag sewing machines, a needle is provided that is fixed movably in a lateral direction perpendicular to a feed sewing direction and a feed dog that enables a work cloth to be moved in the feed direction, a stepping motor for swinging the needle via a swinging mechanism, and a stepping motor for driving the feed dog via a linked material feed mechanism. The sewing operation is performed by driving the stepping motors both for swinging and driving to control the vertical movement of the needle bar based on zigzag width data and feed pitch data, respectively, stored in sewing patterns, such as straight patterns and zigzag patterns, which can be selected.

For example, when a patchwork quilt is made by joining together a plurality of small work cloths, or pieces, using a straight pattern sewn at a designated seam allowance of, for example, 7 mm away from the edges of the work cloths, the straight pattern needs to have been previously copied on to each of the work cloths, or pieces, to be sewn using a writing utensil, such as a French chalk, to provide a designated seam allowance. If a scale is indicated on the top of the machine bed, a seam allowance can be easily identified using the scale. Therefore, it is easy to mark a desired seam allowance on the edges of the work cloths, or pieces, at designated distances using a writing utensil, such as the French chalk.

On the other hand, another conventional zigzag sewing machine is disclosed in U.S. Pat. No. 4,876,977. In the disclosed machine, when a zigzag pattern is selected, a zigzag width and a stitch length for the zigzag pattern are displayed on the display. Then, when a straight pattern is selected, a distance from a predetermined reference position (e.g., left end or center) in a lateral long needle hole of the presser foot to a needle penetration position is displayed on the display.

In either case mentioned above, however, a distance from an absolute position to a needle penetration position, that is, a seam allowance is not easily obtained.

As described above, when a pattern is sewn, it is not easy to find a seam allowance, therefore, the line for the seam allowance needs to be marked at the edge of a work cloth to be sewn using a writing utensil, such as a French chalk, before sewing. To make a large-sized patchwork quilt, where a plurality of small cloths, or pieces, are joined together at a designated stitching position from each edge, takes a long time and it is a heavy burden to mark the pattern on the work cloths, or pieces, and a great deal of French chalk is wasted, which leads to a higher material cost.

SUMMARY OF THE INVENTION

The invention was made in consideration of the above circumstances. Therefore, the objects of the invention are to simplify the setting of a seam allowance width just by aligning an edge of a work cloth with a specified position on the sewing machine; to enable the confirmation of the seam allowance width from a display on the sewing machine; and to apply the method to set a seam allowance to a presser foot whether it is an accessory or a commercially available item.

A sewing machine described in embodiments of the invention to accomplish these objects, comprises a needle, a lateral moving mechanism that moves the needle in a lateral direction perpendicular to a sewing direction of a work cloth, a needle position setting device that sets a needle position within a moving range through which the lateral moving mechanism can move the needle, a positioning device disposed on the sewing machine, the positioning device having a positioning portion to align an edge of the work cloth, and a width information storing device that stores information on a width between the positioning portion and a predetermined reference position which is determined within the moving range.

In the width information memory, information on the width, or distance between the positioning portion of the positioning device, such as a presser foot or a needle plate, and a predetermined reference position is stored. Accordingly, based on the width from the reference position of the needle (e.g. the center of the hole in the presser foot) and the width information, the width from the positioning device to the reference position of the needle can be obtained. Therefore, it is possible to sew with a desired seam allowance width easily just by aligning the edge of the work cloth with the positioning portion.

In a preferred form of the invention, the needle position setting device comprises a seam allowance setting device that sets a seam allowance width from the edge of a work cloth to the needle position. Therefore, the seam allowance width can be easily set by the seam allowance setting device, and the needle position can be changed based on the seam allowance width.

In another preferred form of the invention, the positioning device comprises a presser foot, and the positioning portion is disposed on at least one of a left end and a right end of the presser foot.

Therefore, positioning of the edge of the work cloth is simply a matter of aligning the edge of the work cloth with the left or right end of the presser foot.

In a further preferred form of the invention, the reference needle penetration position is set to the needle penetration position where the moving amount of the needle activated by the lateral moving mechanism is zero. Therefore, a half of the width of the presser foot can be calculated as a seam allowance width, and the calculation process can be simplified.

In another preferred form of the invention, the sewing machine further comprises a needle position supervise device that supervises current needle position information on a current needle position in the lateral direction, and a seam allowance width calculating means that calculates a seam allowance width based on the width information stored in the width information storing device and the current needle position information overseen by the needle position supervise device.

Therefore, the seam allowance width can be surely calculated based on the width information stored in the width information storing device and the needle position information overseen by the needle position supervise device.

In a further preferred form of the invention, the sewing machine comprises a movement amount calculating device that calculates a movement amount of the needle in the lateral direction based on a set value of the seam allowance width determined by the seam allowance setting device and a calculated value of the seam allowance determined by the seam allowance width calculating device.

If the seam allowance width set by the seam allowance setting device is different from the actual seam allowance width determined by the seam allowance calculating means, the movement amount calculating device calculates the movement amount of the needle in the lateral direction so as to equalize the actual width and the set width.

In another preferred form of the invention, the sewing machine further comprises an informing device that informs an operator of the seam allowance width set by the seam allowance setting device. Therefore, a user can confirm the seam allowance width currently set from the informing device.

In a further preferred form of the invention, the informing device comprises a display, and a display controlling device that controls the display to display the seam allowance width set by the seam allowance setting device. Therefore, a user can confirm the seam allowance width currently set from the display.

In another preferred form of the invention, the display control device controls the display to display the seam allowance width along with a positioning mark indicating the positioning portion.

Therefore, a user can determine which positioning portion of the positioning device the edge of the work cloth should be aligned with from the positioning mark shown on the display.

In a further preferred form of the invention, the display includes a zigzag width display area to display a zigzag width when a zigzag stitch pattern is selected. The display control device controls the display to display the seam allowance width in the zigzag width display area when a straight stitch pattern is selected.

The zigzag width and the seam allowance width, which are both related to the movement of the needle, are shown in the same area of the display, and this has the advantage of being easily understood by a user.

In another preferred form of the invention, the display control device controls the display to display selectively one of the zigzag width and the seam allowance width in the zigzag width display area. There is no need to indicate both the zigzag width and the seam allowance width on the display at the same time, therefore, the best possible use of the available display space can be made by switching the display between the zigzag width and the seam allowance width.

In a further preferred form of the invention, the sewing machine further comprises a display mode storing device that stores mode information to distinguish between a zigzag width display mode where the zigzag width is displayed in the zigzag width display area and a seam allowance display mode where the seam allowance is displayed in the zigzag width area.

Therefore, the display mode storing device stores a mode flag of either the seam allowance width display mode or the zigzag width display mode, which has been changed over and then set. Where a rewritable and non-volatile memory is used as the display mode storing device, in particular, when the power is turned on, the mode that was set just before the power is turned off will appear.

In another preferred form of the invention, the display control device controls the display to display the seam allowance width using graphics. Therefore, a user can easily confirm the seam allowance width from the visual image.

In a further preferred form of the invention, the display control device includes an actual-size display control means that controls the display to display the seam allowance width by a visual image of a bar with an actual size.

In the seam allowance display mode, the actual-size display data to display the seam allowance width by a visual image of a bar having the actual size, is created at the actual-size display control means, and is shown on the display. Therefore, the actual size display will allow the seam allowance width to be easily checked whichever country it is used in without consideration whether the unit of measure is centimeters or inches.

In another preferred form of the invention, the width information storing device stores information on the width of a presser foot in relation to a type of presser foot.

Therefore, if a different type of presser foot is attached to the machine, corresponding width information is read from the width information memory, and the seam allowance width can be correctly calculated.

In a further preferred form of the invention, the width information storing device comprises a rewritable and non-volatile storage medium. Therefore, it is possible to add new width information to the width information memory and change the information, for example, when a commercially available presser foot is attached to the machine.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A preferred embodiment of the invention will be described in detail with reference to the accompanying drawings.

The embodiment of the invention is an example of the invention being applied to an electronically-controlled zigzag sewing machine that enables the sewing of not only practical sewing patterns but also various embroidery patterns using a detachable embroidery frame driving device (a so called embroidery device).

Figure 1:
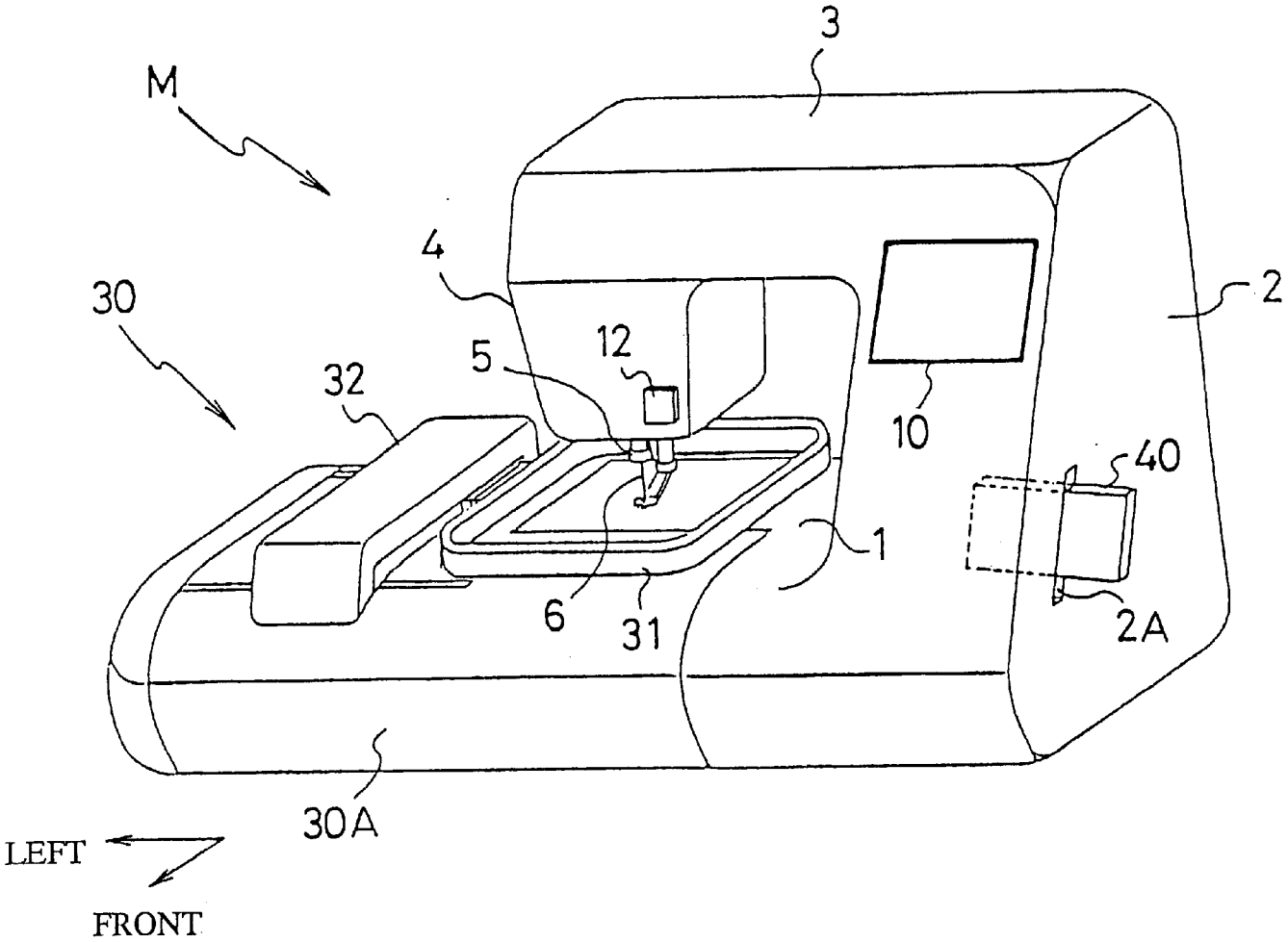
FIG. 1 is a perspective view of an electronically-controlled zigzag sewing machine related to embodiments of the invention.

Zigzag sewing machine M has, as shown in FIG. 1, a machine bed 1, a standard portion 2 that stands on the right of the bed 1, and an arm 3 extending from the upper part of the standard portion 2 toward the left in parallel with the bed 1.

Figure 2:
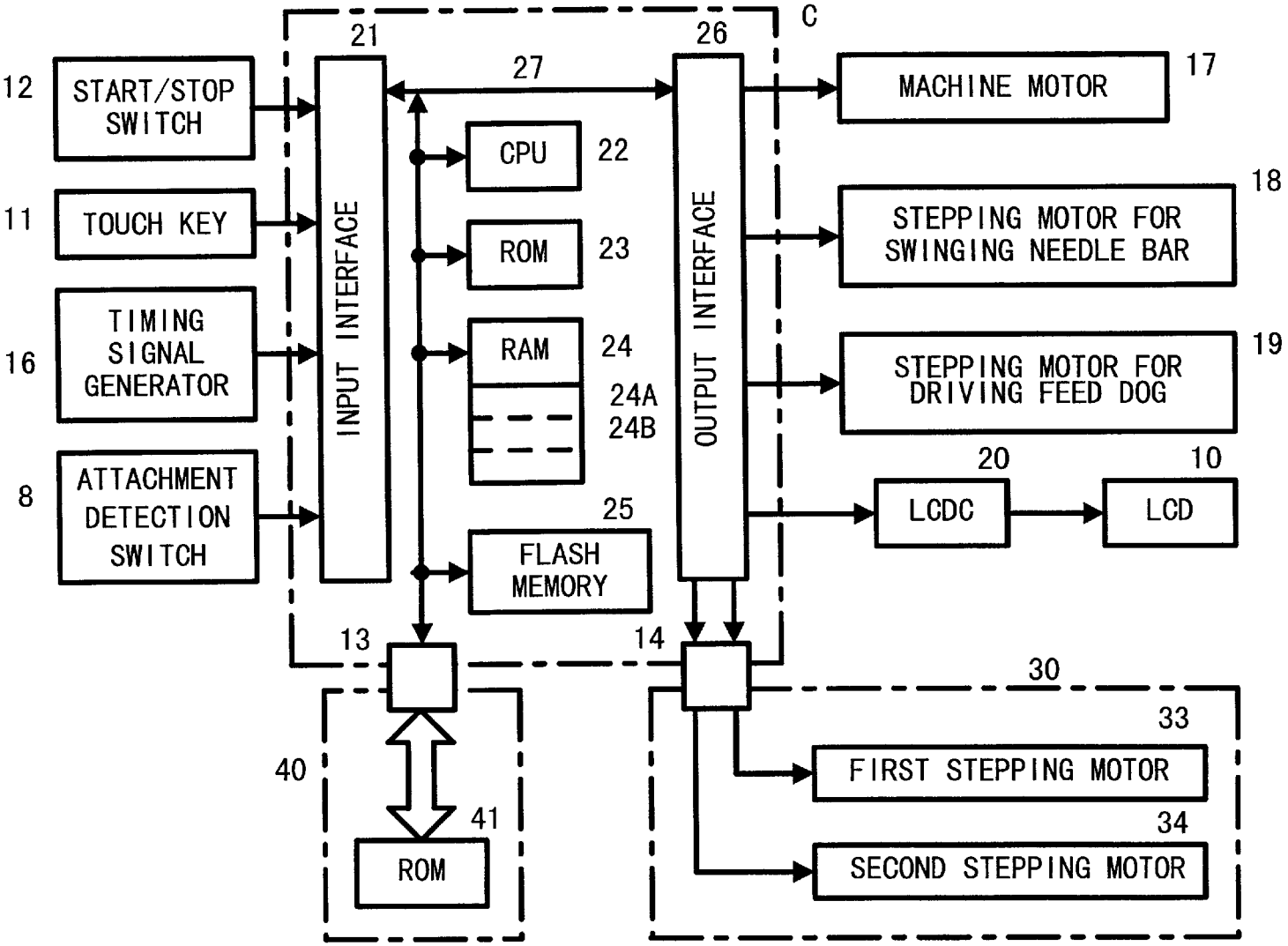
FIG. 2 is a control block diagram of the elements of the zigzag sewing machine.

The bed 1 includes a feed dog up and down moving mechanism (not shown), a feed dog back and forth moving mechanism (not shown), and a loop taker (e.g. a vertical axis oscillating shuttle, not shown) that contains a lower thread bobbin and cooperates with a needle 6. On the side of the standard portion 2, there is a slot 2*a* to insert a ROM card 40 storing pattern data (sewing data and pattern display data), which can be used as an optional data source, for electrical connection to a CPU 22 throughout internal connector 13 (FIG. 2).

The arm 3 includes a needle bar driving mechanism (not shown) that moves a needle bar 5 holding a needle 6 up and down, a needle bar swinging mechanism (not shown) that swings the needle bar 5 in a direction perpendicular to a feed direction of a work cloth, and a thread take-up driving mechanism (not shown) that moves a thread take-up in accordance with the up and down movement of the needle bar 5. The feed dog up and down moving mechanism, the needle bar driving mechanism, and the thread take-up driving mechanism are driven by a machine motor 17; the needle bar swinging mechanism is driven by a stepping motor 18 for swinging, or oscillating, the needle bar; and the feed dog back and forth driving mechanism is driven by a stepping motor 19 for moving the feed dog back and forth (FIG. 2). A machine head 4 in the arm 3 has a start/stop switch 12 that orders a start and stop of the sewing operation.

A large-sized liquid crystal display 10 (LCD) is provided in the front of the arm 3, which shows stitch types, pattern names, function names, and messages assigned to various practical sewing patterns and embroidery patterns. A plurality of touch keys 11, which are transparent electrodes and correspond to function names and pattern names, are arranged on a grid on the LCD 10. Namely, selection of a desired embroidery pattern or instructing execution of a function can be executed simply by pressing a corresponding touch key 11.

On the left end of the bed 1, a free bed, generally known as a free arm (not shown), is formed where an embroidery frame driving mechanism 30 is detachably fixed. The embroidery frame driving mechanism 30 has a housing 30*a*, an embroidery frame 31 that can detachably hold a work cloth, a Y-axis direction driving part 32 including a Y-axis direction moving mechanism that moves the embroidery frame 31 in the Y-axis direction (back and forth), and an X-axis direction moving mechanism that is contained in the housing 30*a*. The X-axis direction moving mechanism is driven by a first stepping motor 33 and the Y-axis direction driving mechanism is driven by a second stepping motor 34 (FIG. 2).

When the embroidery frame driving mechanism 30 is attached to the free bed, the first and second stepping motors 33 and 34 are electrically connected to a controller C of the machine M via a connector 14. An attachment detection switch 8 (FIG. 2), provided in the machine M, is activated and, at that time the controller C controls the operation of stepping motors 33, 34, and the embroidery frame 31, a work cloth as set is moved in the X- and Y-axis directions individually to perform an embroidering operation. On the other hand, if the embroidery frame driving mechanism 30 is not attached, it is possible to sew practical patterns, such as straight and zigzag.

The control system of the electronic-controlled sewing machine M will now be described.

As shown in FIG. 2, the controller C comprises an input interface 21, a CPU 22, a ROM 23, a RAM 24, a flash memory 25 that is nonvolatile and rewritable electrically, an output interface 26, and a data bus 27 that serves to connect the elements. The input interface 21 is connected to the start/stop switch 12, the touch keys 11, a timing signal generator 16 that detects a plurality of rotating phases of the sewing machine main shaft, and the attachment detection switch 8 that detects whether the embroidery frame driving mechanism 30 is attached.

The output interface 26 is connected to motors 17, 18, 19, a display controller (LCDC) 20 for the LCD 10, and the first and second stepping motors 33, 34 for the embroidery frame driving mechanism 30 via the connector 14. A ROM 41 of the ROM card 40 is connected to the data bus 27 via the internal connector 13.

The ROM 23 stores control programs, such as pattern selection control for selecting a desired practical sewing pattern or embroidery pattern, sewing control, and display control, and includes a pattern data member 23*a*. The pattern selection control including display control is peculiar to this application, which will be described later.

Figures 3, 4:
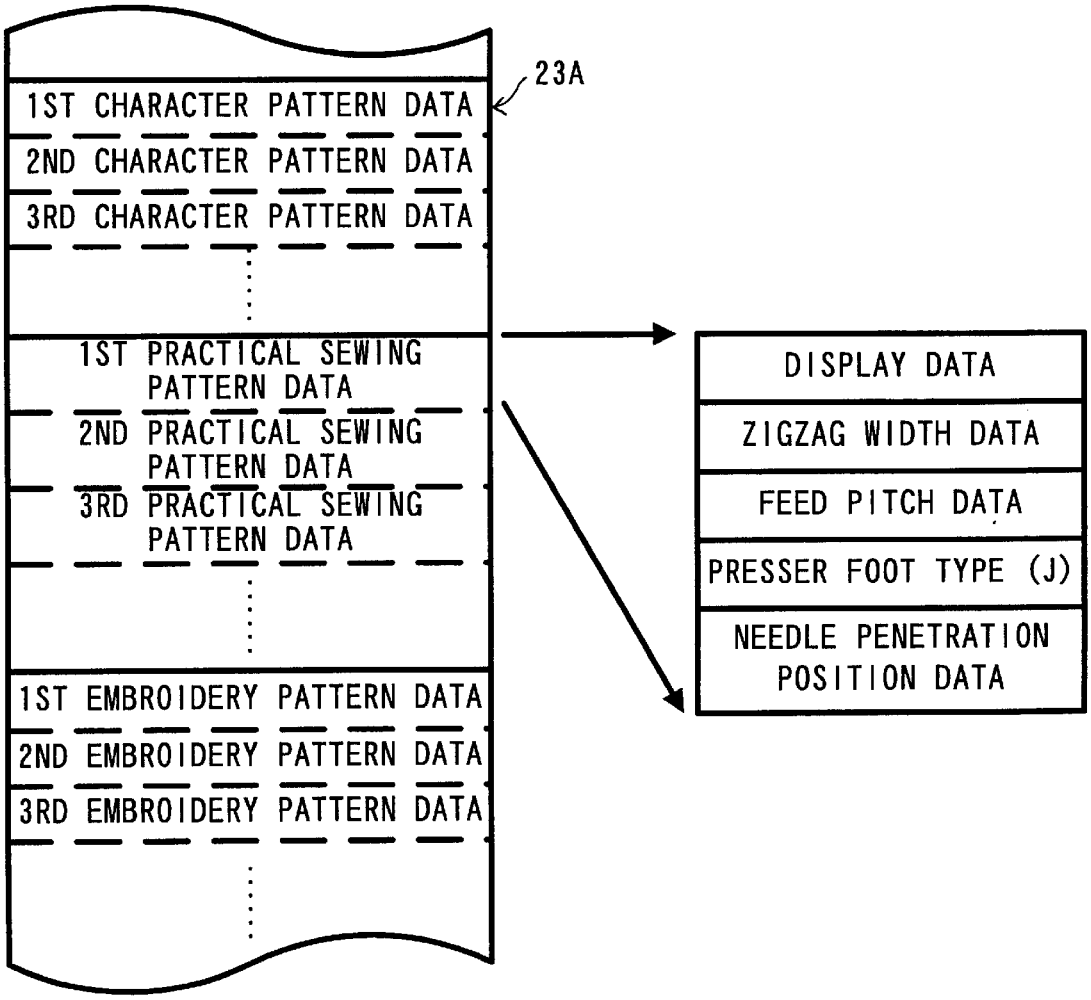
FIG. 3 shows the structure of data stored in the pattern data memory.
FIG. 4 shows the structure of data stored in the width information memory.

The pattern data memory 23*a* of the ROM 23, shown in FIG. 3, stores a plurality of pieces of character pattern data related to numbers and letters, practical sewing pattern data including straight and zigzag, and embroidery pattern data that has a high frequency of use. Each of the pattern data comprises display data and sewing data, and is divided into functional groups identified, in this description by numbers.

Each practical sewing pattern data has display data which shows the stitch formation for a selected pattern, zigzag width data for zigzag stitching, feed pitch data, a type of presser foot 7 (FIGS. 7 and 14), and needle penetration position data which indicates where the needle 6 is at the start of sewing. For zigzag patterns, the needle 6 needs to be swung for making zigzag stitches, therefore, a plurality of pieces of needle penetration positions data are stored in the memory.

On the other hand, the width information memory 25A of the flash memory 25 stores width dimensions Fw, the reference needle penetration position dimensions A, and mode flags F for display mode described later, according to the type (J, G, A, and R) of presser foot 7 (FIG. 4), which all can be changed by the operator.

Figure 7:
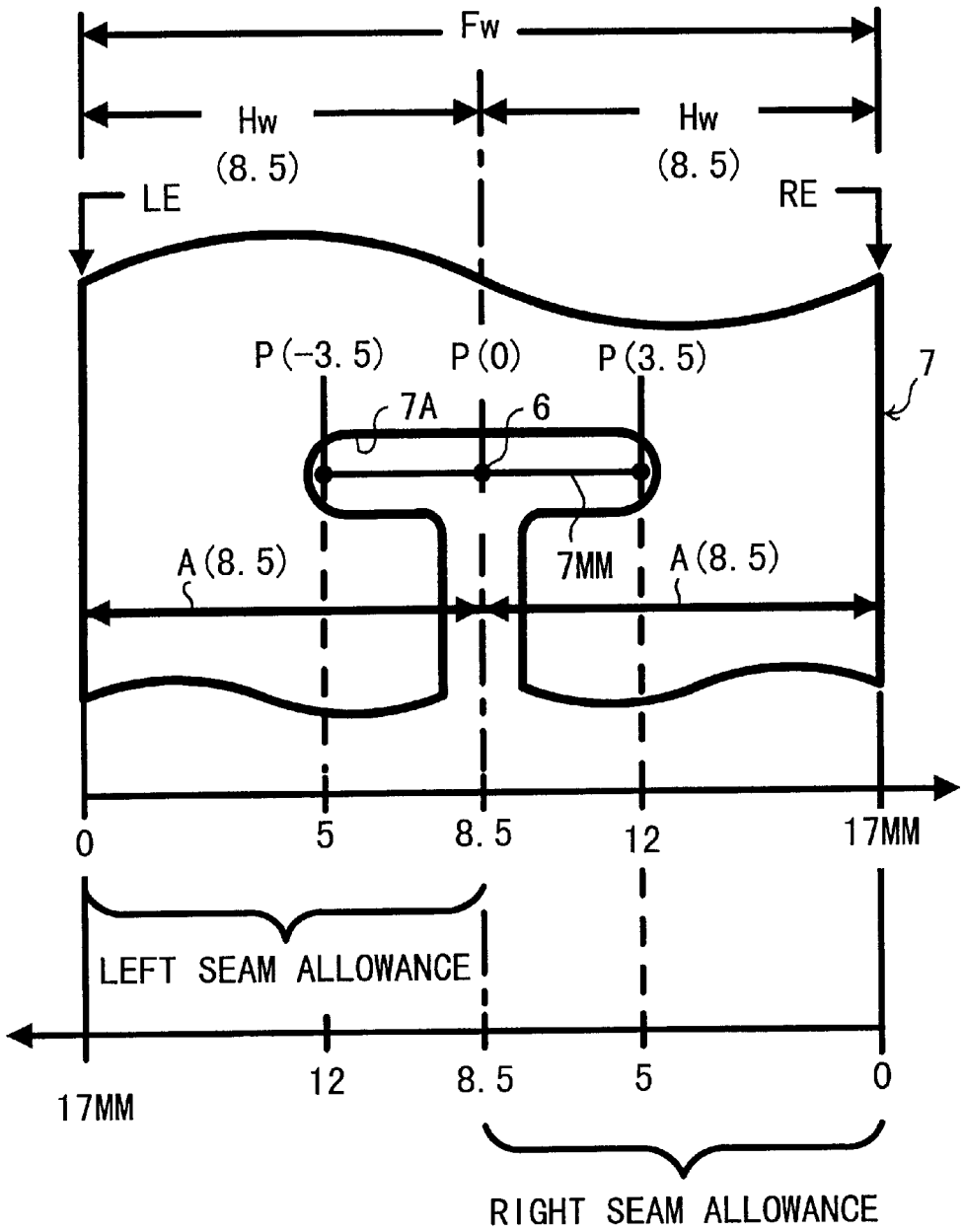
FIG. 7 is an enlarged top view of the presser foot.

A type J presser foot 7 will be used, as an example for the explanation to follow. As shown in FIG. 7, a laterally elongated needle hole 7*a* (with a width of 7 mm) is formed in the presser foot 7 for zigzag stitching, and the reference position of the needle 6 in the hole 7*a* is set to the center position P (0). Width Fw of the presser foot 7 is a dimension from the left end LE to the right end RE (approx. 17 mm), and the reference needle penetration position dimension A is equal to a half width Hw (8.5 mm) of the width Fw. The left seam allowance width is a dimension from the left end LE of the presser foot 7 to the needle penetration position P, e.g. center P (0), and it can be changed from the farthest possible left position of the needle 6 when it is swung in the left half width Hw direction (from 5 mm to 8.5 mm).

The right seam allowance width is a dimension from the right end RE of the presser foot 7 to the needle penetration position P, e.g. center P (0), which can be changed from the farthest right position of the needle 6 when it is swung in the right half width Hw direction (from 5 mm to 8.5 mm). Generally, the seam allowance width used for normal straight pattern sewing is within 5–8 mm. In this embodiment, when the left end of the work cloth W is aligned with the left end LE of the presser foot 7, the left seam allowance width can be set up to 8.5 mm; and when the right end of the work cloth W is aligned with the right end RE of the presser foot 7, the right seam allowance width can be set up to 8.5 mm.

In the RAM 24, a pattern number memory 24*a* stores a pattern number assigned to a selected sewing or embroidery pattern. A calculation information memory 24*b* stores zigzag width data, feed pitch data, a type of presser foot 7, needle penetration position P, width dimension Fw, half width dimension Hw, and the reference needle penetration position dimension A for a selected sewing pattern. Further, the RAM 24 includes memories required for each control described above (e.g., flag memory, pointer memory, counter memory, register, buffer).

Pattern selection control, including display control, executed in the controller C will be explained with reference to the flowcharts of FIGS. 5 and 6. In the flowcharts, Si (i=1, 2, . . .) stands for a procedure step.

Figure 5:
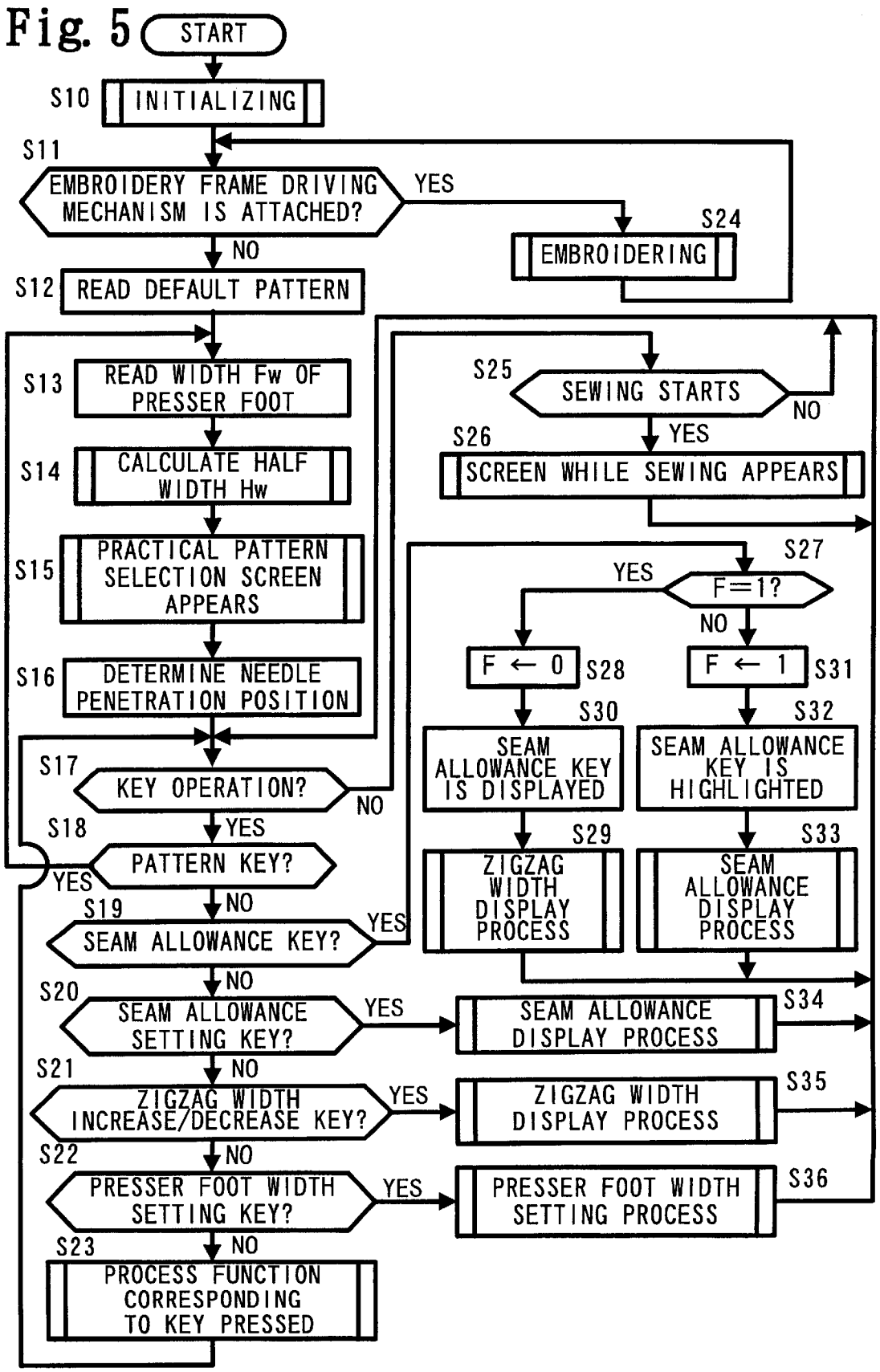
FIG. 5 is a flowchart of the pattern selection control.

When the power is turned on and the pattern selection control, shown in FIG. 5, is started, initialization, such as clearing each memory in the RAM 24 is performed (S10). Based on a detecting signal issued from the attachment detection switch 8, if the embroidery frame driving mechanism 30 is attached to the free bed (S11: Yes), a desired one of the embroidery patterns is selected and embroidering for the selected pattern is performed (S24).

If the embroidery frame driving mechanism 30 is not attached (S11: No), it is possible to sew a practical sewing pattern. A pattern previously set as a default (e.g. a straight pattern) is read (S12), a width Fw for a type of presser foot set in the pattern is read and stored into the calculation information memory 24*b* (S13), and a half width Hw of the width Fw is found by calculation and stored into the calculation information memory 24*b* (S14). A practical pattern selection screen showing the set pattern in the designated display area appears on the LCD 10 (S15).

Figure 8:
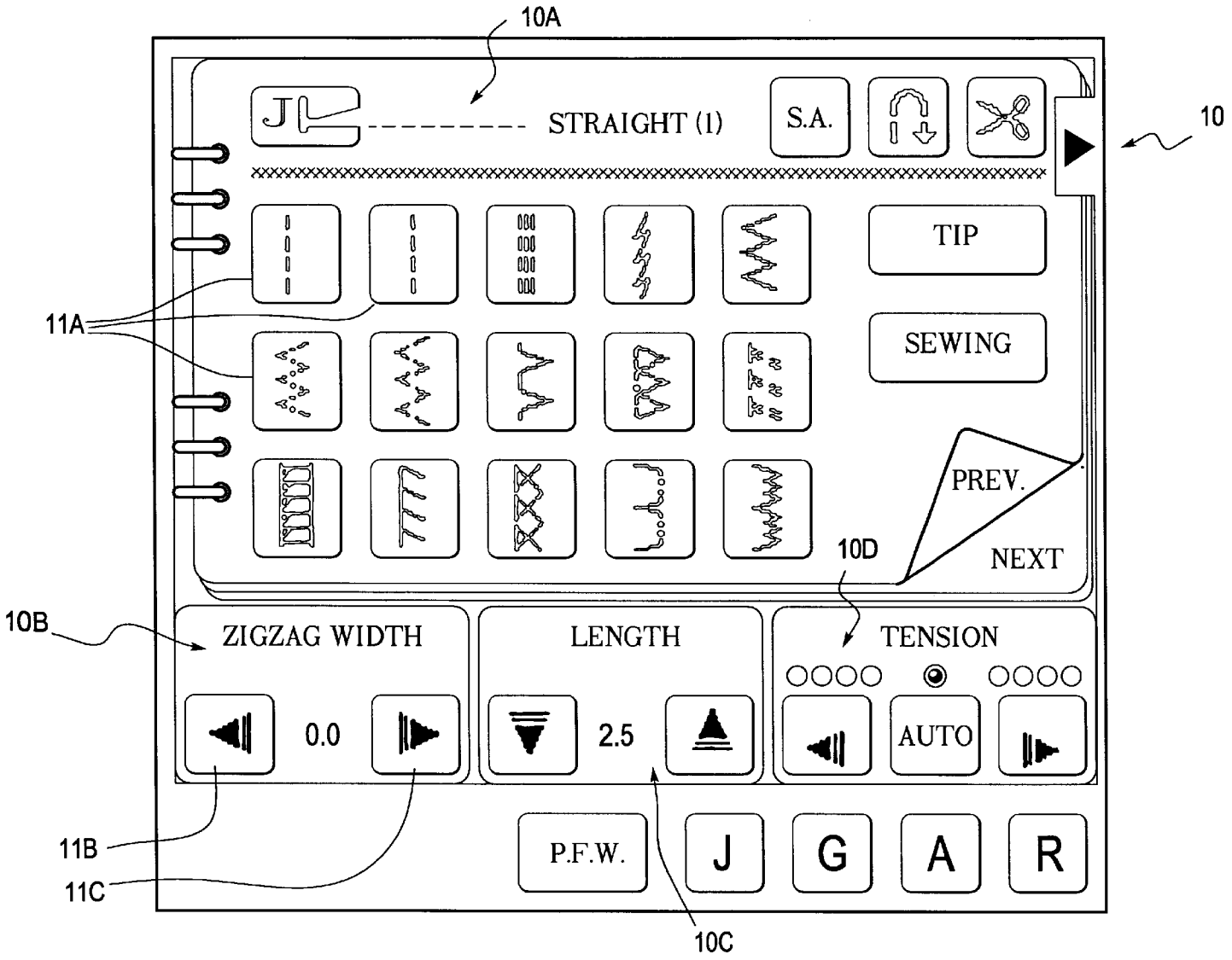
FIG. 8 shows an example of the practical pattern selection screen.

For example, as shown in FIG. 8, the LCD 10 shows the practical sewing pattern selection screen which indicates pattern name "straight (1)" set as a default in the selection pattern display area 10*a* which is at the top of the screen. In the zigzag width display area 10*b*, which is on the bottom of the screen, the zigzag width of the needle 6, "0.0" is displayed along with the zigzag width increase/decrease keys 11*c*, 11*b*. In the stitch length display area 10*c*, the stitch length "2.5" is displayed, and in the thread tension display area 10*d*, a degree of the thread tension is displayed. At the bottom of the display is a presser foot width setting key and types (J, G, A, R) of presser foot 7 are indicated.

The zigzag width "0.0", which appears when the straight pattern is selected, means that the needle penetration position P for the needle 6 is at the farthest left position, that is, at the left end in the needle hole 7*a*.

Next, the first needle penetration position for the set pattern is read and set (S16). In other words, the stepping motor 18 for swinging the needle bar is driven, and the needle 6 is moved so that it can be at a corresponding position. Then, when a pattern key 11*a* corresponding to a stitch pattern is pressed (S17 and S18: Yes), steps S13–S18 are repeatedly performed, and the selected stitch pattern appears in the selection pattern display area on the practical pattern selection screen.

Figure 9:
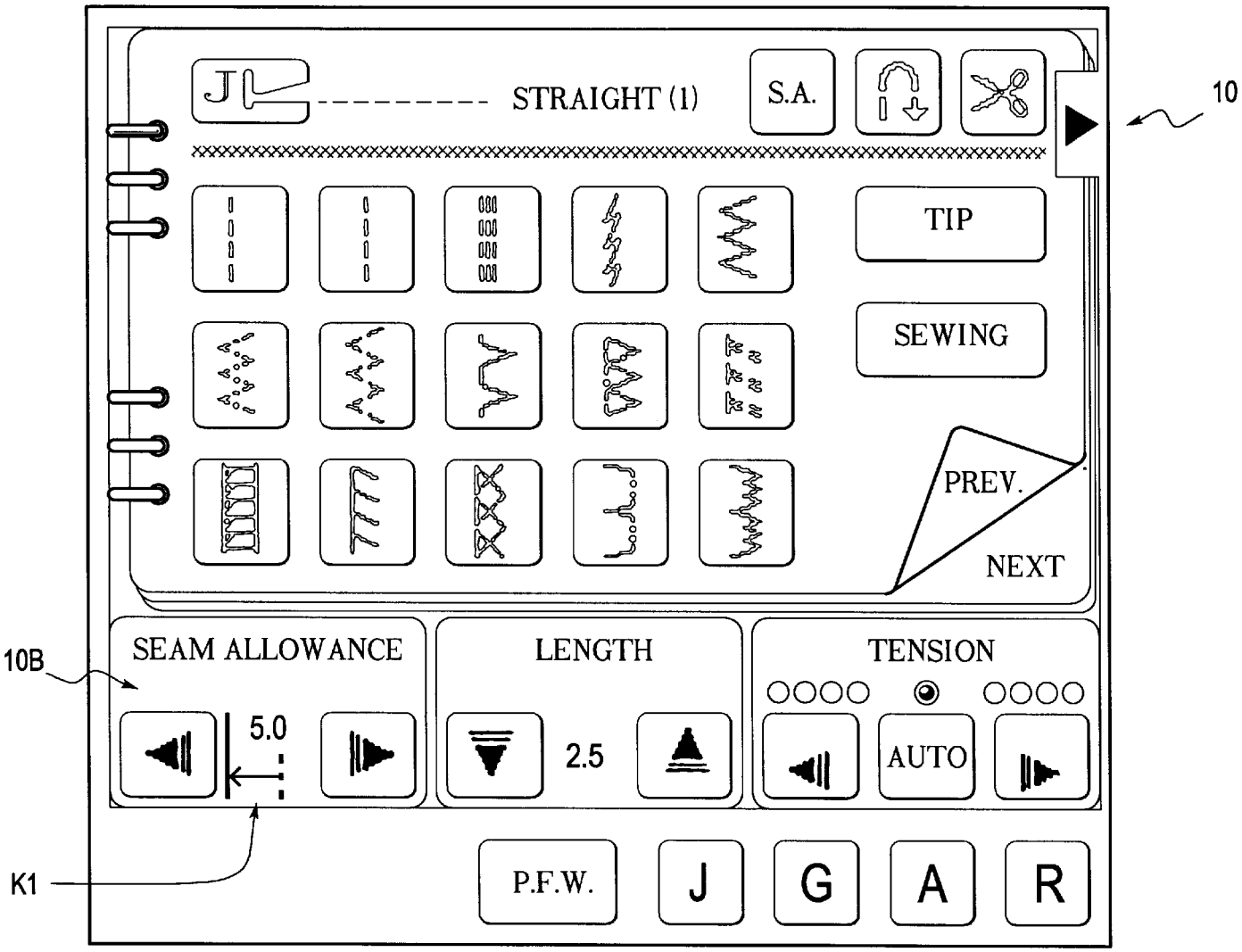
FIG. 9 corresponds to FIG. 8 except that the seam allowance width and the left end mark are indicated.

When the seam allowance key is pressed (S17: Yes, S18: No, S19: Yes), the display mode flag F in the width information memory 25A is reset, i.e., is 0, and the zigzag width display mode is set (S27: No), the display mode flag F is set, the seam allowance display mode is set (S31), the seam allowance key is displayed highlighted (S32), and the seam allowance display processing control (refer to FIG. 6) to display the seam allowance width instead of zigzag width is performed (S33). For example, as shown in FIG. 9, the seam allowance key which is on the top of the screen is displayed highlighted. Since the display mode flag F is stored in the width information memory 25A, when the power is turned on, the display mode for the seam allowance or the zigzag width that was set just before the power is turned off will appear.

Figure 6:
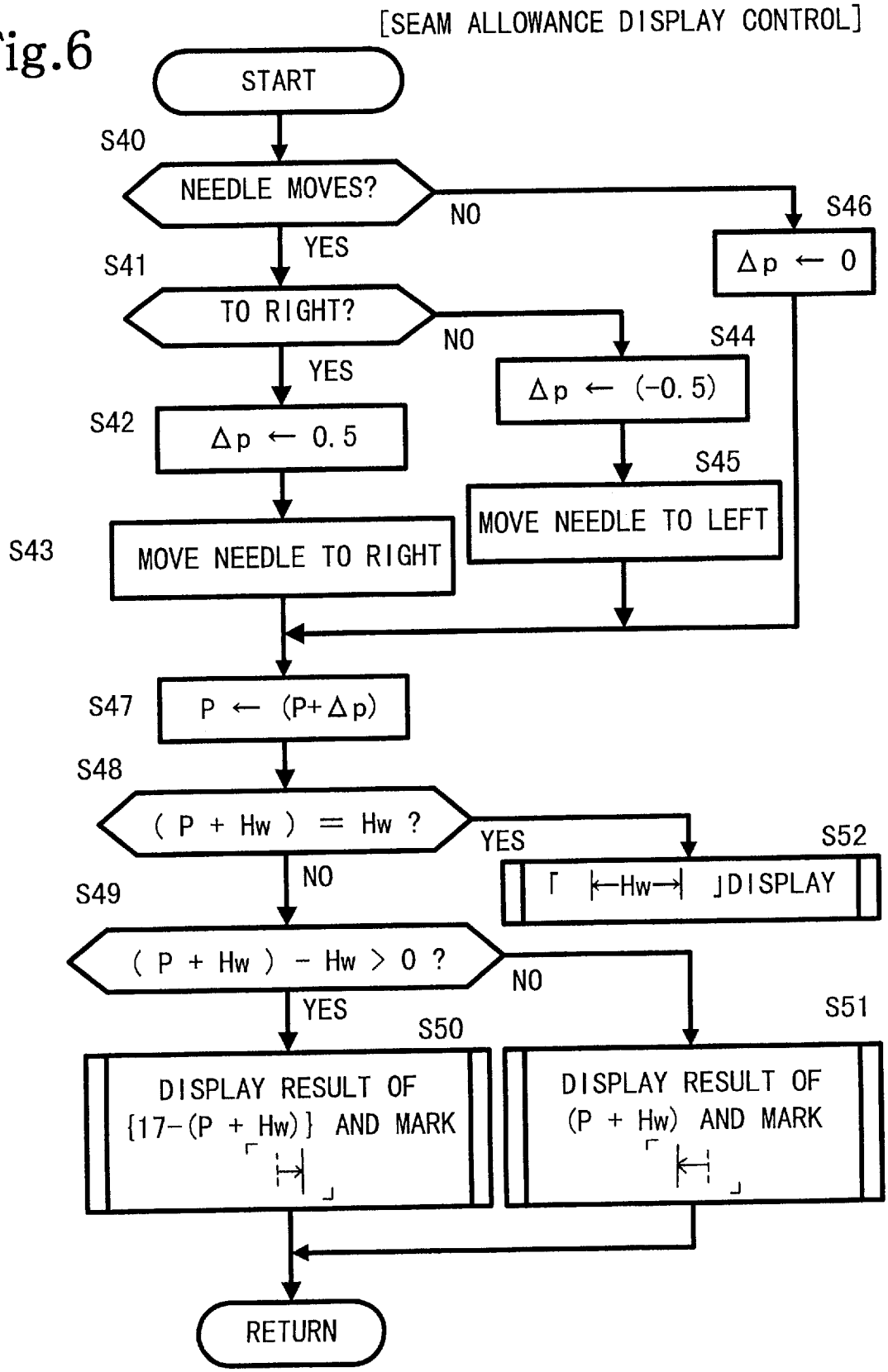
FIG. 6 is a flowchart of the seam allowance display processing control.

When the seam allowance display processing control, shown in FIG. 6, is started and the seam allowance key is pressed, the needle 6 is not moved (S40: No), and the needle movement amount Δp is set to 0 (S46). As the needle penetration position P of the needle 6, only the needle movement amount Δp is added (S47). If the value of the needle penetration position P plus the half width Hw is equal to the value of the half width Hw (S48: Yes), the needle penetration position P is the center P (0) and the seam allowances from the center to the left end LE and the right end RE of the presser foot 7 are the same. The zigzag width display area 10*b* shows the value of the half width Hw along with a both-ends mark K3 (S52) (FIG. 10), control is completed, and the process returns to S17 of the pattern selection control.

Figure 11:
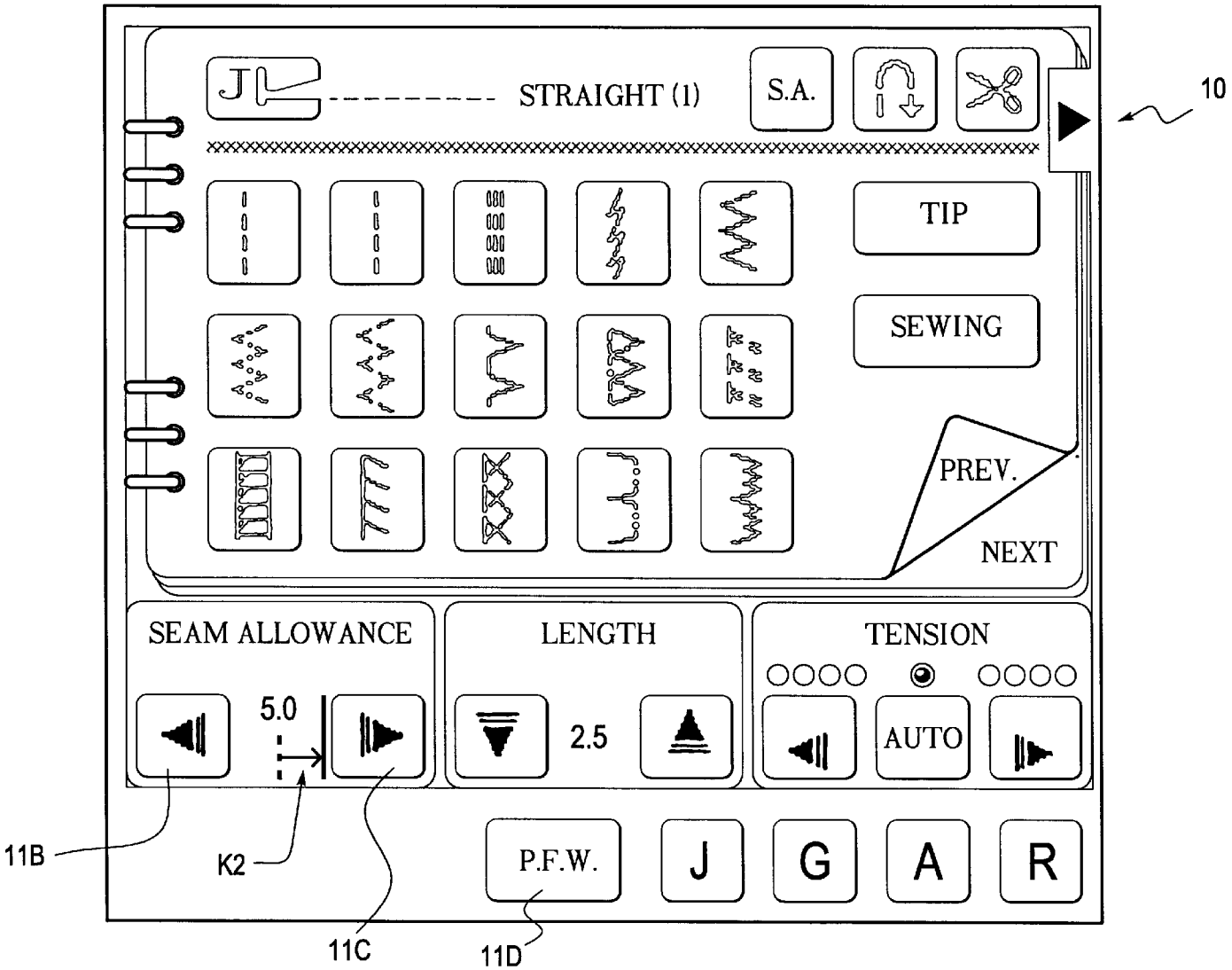
FIG. 11 corresponds to FIG. 8 except that the seam allowance width and the right end mark are indicated.

However, if the value of the needle penetration position P plus the half width Hw is not equal to the value of the half width Hw (S48: No), and is greater than the value of the half width Hw (S49: Yes), this means the needle 6 is in the right seam allowance, and the zigzag width display area 10*b* shows a seam allowance found from formula {17–(P+Hw)} along with the right end mark K2 (S50) (FIG. 11). If the value of the needle penetration position P plus the half width value Hw is not equal to the value of the half width Hw (S48: No), and is less than the value of the half width Hw (S49: No), this means the needle 6 is in the left seam allowance, and the zigzag width display area 10*b* shows a seam allowance found from formula (P+Hw) along with the left end mark K1 (S51) (FIG. 9).

Figure 10:
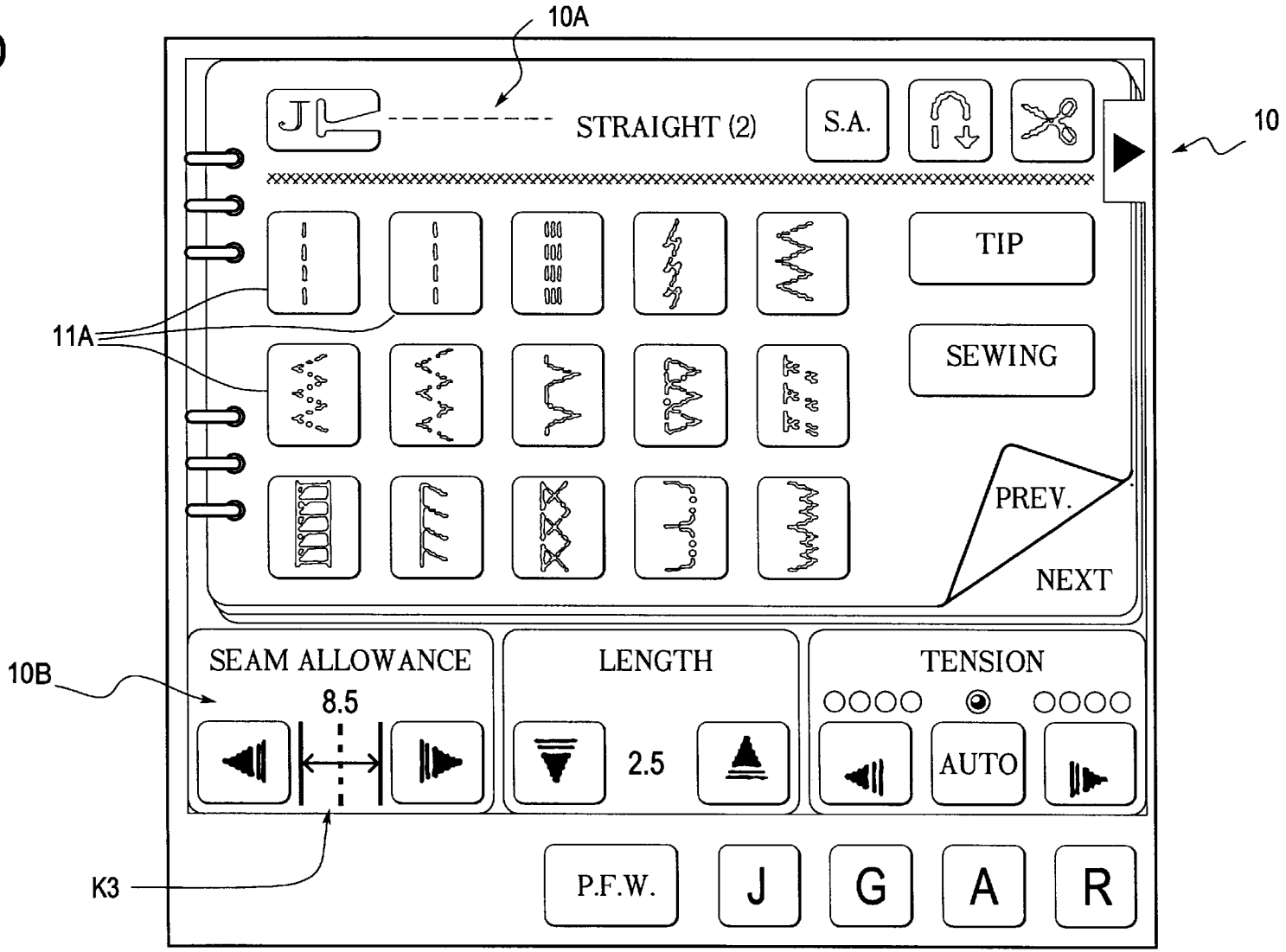
FIG. 10 corresponds to FIG. 8 except that the seam allowance width and the both-end marks are indicated.

The first straight pattern "Straight (1)", which is a default pattern, has a zigzag width of 0.0 mm, and the needle penetration position P is positioned at the left end of the needle hole 7*a*. This means the needle is in the left seam allowance. Therefore, the seam allowance width "5.0" mm and the left end mark K1 are displayed in the zigzag width display area 10*b* in FIG. 9 by S50. In the seam allowance display mode, when the pattern keys 11*a* are pressed to select the second straight pattern "Straight (2)", the half width Hw appears along with both-ends mark K3 as shown in FIG. 10 by S52, and the needle penetration position P is P (0) in the center of the needle hole 7*a*.

When a zigzag pattern is selected, the main shaft of the sewing machine is rotated manually to swing the needle 6. Accordingly, the seam allowance corresponding to the swinging position is established and displayed.

As shown in FIG. 5, when the seam allowance setting key 11B or 11C is pressed under the condition where the straight pattern is selected (S17: Yes, S18 and S19: No, S20: Yes), the seam allowance display processing is performed (S34). Hereinafter, the seam allowance display processing will be described in detail with reference to the flowchart as shown in FIG. 6. When the seam allowance setting key 11C is pressed (S40: Yes, S41: Yes), "+0.5 mm" is assigned to the needle movement amount Δp (S42), and the command to move the needle 6 to the right is performed (S43). As a result, the stepping motor 18 for swinging the needle bar is driven, and the needle 6 is moved 0.5 mm to the right needle penetration position.

When the seam allowance setting key 11*b* is pressed to move the needle 6 to the left (S41: No), "−0.5 mm" is assigned to the needle movement amount Δp (S44), and the command to move the needle 6 to the left is performed (S45). As a result, the stepping motor 18 for swinging the needle bar is driven, and the needle 6 is moved 0.5 mm to the left needle penetration position. Then, steps on and after S47 are performed as described above, and the seam allowance width along with mark K1, K2, or K3 appears according to the needle penetration position of the needle 6.

If the user wishes to perform sewing with alignment of the right edge of the work cloth with the right edge of the presser foot, he or she should reposition the work cloth first. Then for example, when the seam allowance width "5.0 mm" and left end mark K1 appear as shown in FIG. 9, the seam allowance setting key 11*c* is pressed several times, and the needle 6 is moved to the right until the needle penetration position P of the needle 6 is aligned with the right end of the needle hole 7*a*. At this time, the needle 6 is in the right seam allowance, and the seam allowance width "5.0 mm" and the right end mark K2 appear as shown in FIG. 11.

In the pattern selection control, when the start/stop switch 12 is pressed to start sewing (S17: No, S25: Yes), the LCD 10 indicates the screen which is the same as the one that appears during sewing (S26), motors 17–19 are driven by executing the sewing control, and sewing is performed.

Figure 14:
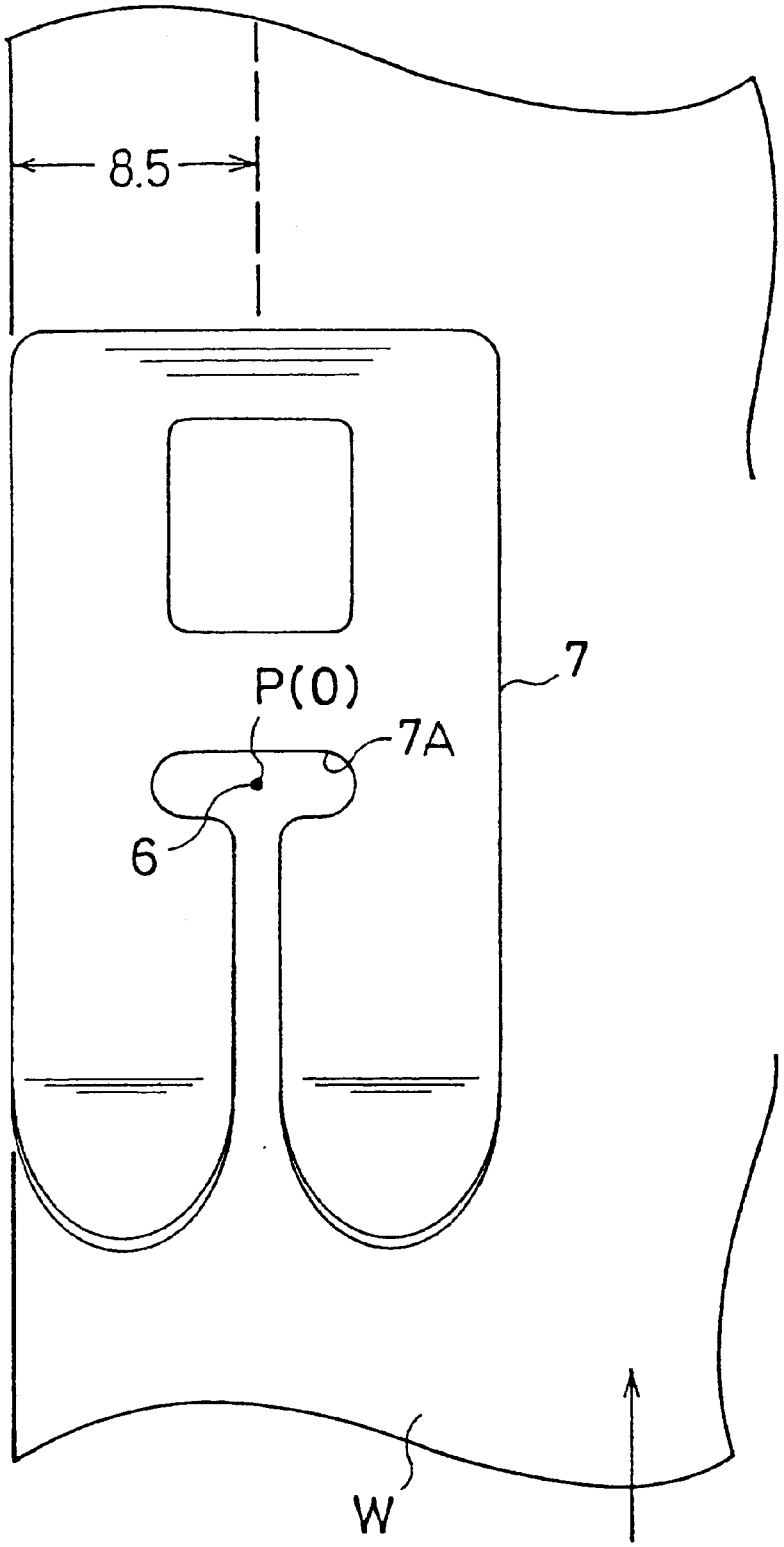
FIG. 14 is an explanatory drawing when a straight pattern is formed on a work cloth.

In order to form the straight stitch pattern at 8.5 mm away from the edge of the work cloth W, the second straight pattern "Straight (2)" should be selected as shown in FIG. 10. When "Straight(2)" is selected, the seam allowance width "8.5 mm" is displayed with both-ends mark K3 automatically, and also the needle 6 moves to the center P (0) as shown in FIG. 14. Straight pattern can be formed with an 8.5 mm seam allowance only by sewing while aligning the edge of work cloth W with the left end LE of the presser foot 7.

When the zigzag width "0.0" appears in the zigzag width display area 10*b*, and the zigzag width increase/decrease keys 11*b*, 11*c* are pressed (S17: Yes, S18–S20: No, S21: Yes), the zigzag width display processing that displays the zigzag width changing according to the keys 11*b*, 11*c*, is performed (S35). When the presser foot width setting key 11*d* is pressed (S17: Yes, S18–S21: No, S22: Yes), the presser foot width setting processing is performed (S36).

Figure 12:
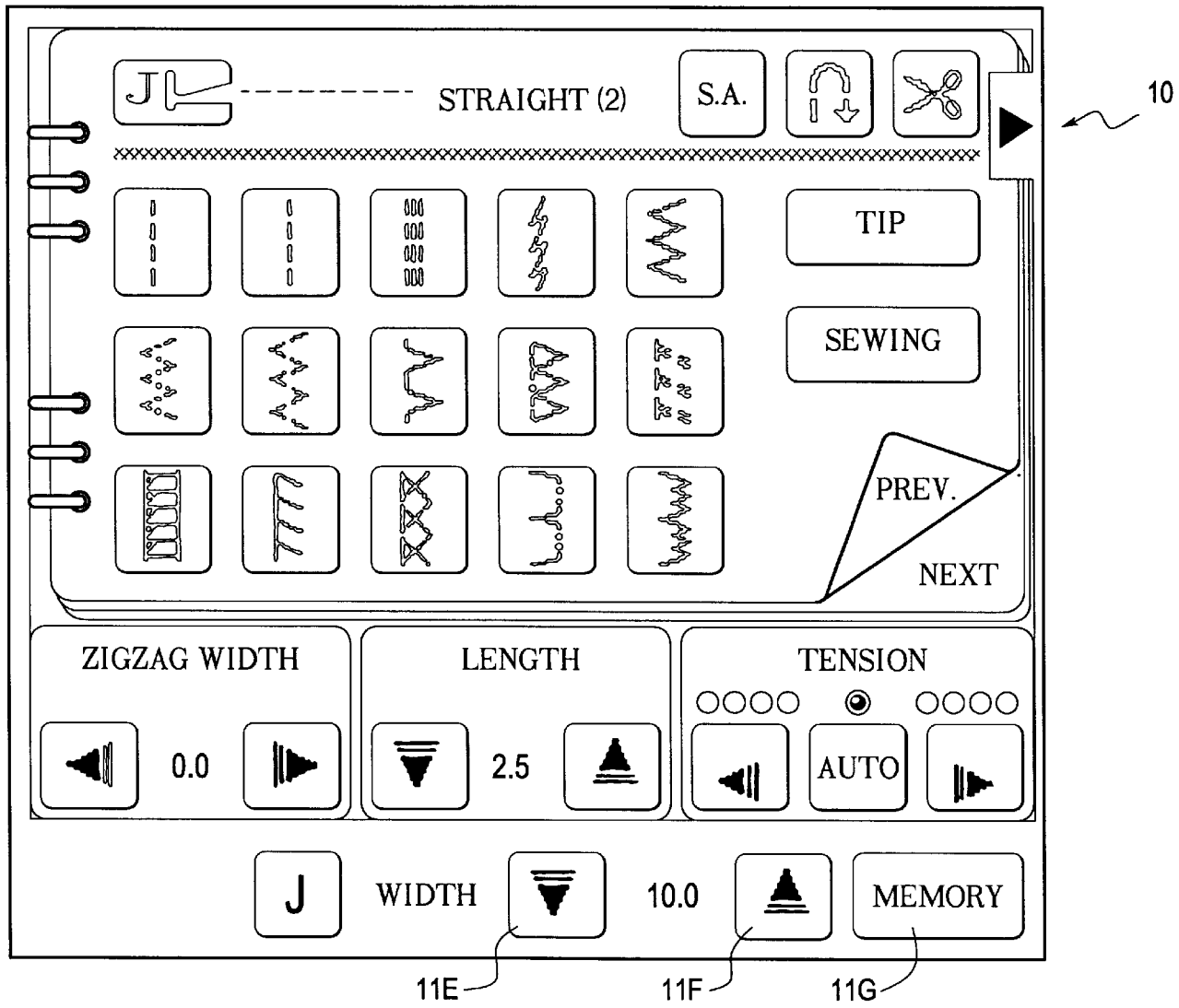
FIG. 12 is an example of the presser foot width setting screen.

When a commercially-available presser foot for straight pattern sewing, whose width Fw is different from the attachment, is used on the machine, the presser foot width setting processing is performed to renew the width Fw. The presser foot width setting processing will be now described in detail. For example, it is assumed that the width Fw of the commercially-available presser foot is newly assigned for presser foot type A. When the presser foot width setting key 11*d* and key "A" indicating the type of presser foot, shown in FIG. 11, are pressed, the presser foot width setting screen appears as shown in FIG. 12. When the increase/decrease keys 11*f*, 11*e* are pressed to set the width of the commercially-available presser foot 7 to "10.0 mm," and the memory key 11*g* is pressed, the width of the presser foot 7 which is assigned to "A" will be renewed as 10.0 mm in the width information memory 25A.

When another function key is pressed (S17: Yes, S18–S22: No), the processing for the function corresponding to the key pressed will be performed (S23).

Figure 13:
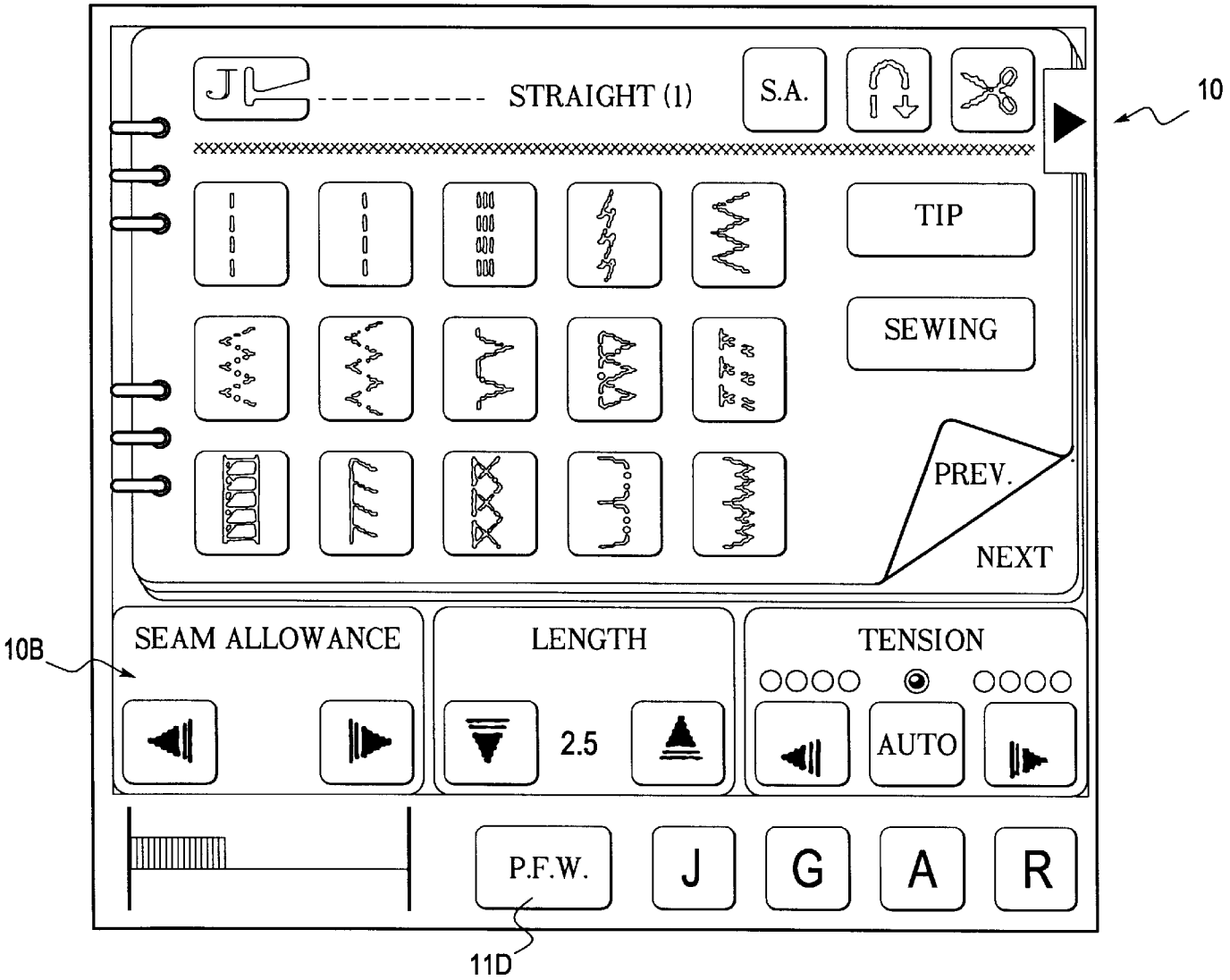
FIG. 13 corresponds to FIG. 8 except that the actual size bar is displayed instead of the seam allowance width.

When the seam allowance display mode is set and the seam allowance width appears (S33, S34), the actual size display data may be created based on the current seam allowance width so that the seam allowance can be displayed by an actual size bar in the zigzag width display area 10*b*. In FIG. 9, the left seam allowance width "5.0" mm and the left end mark K1 appear. Instead, the actual size data may be shown using a bar K4 corresponding to the seam allowance "5.0 mm" to indicate the left seam allowance as shown in FIG. 13. The bar K4 with the actual size helps check the seam allowance easily regardless of the unit of measure (English or metric) or the country of use.

The seam allowance setting keys 11*b*, 11*c* and S42, S44, and S46 in particular of the seam allowance display processing control correspond to a seam allowance setting means; S47 of the seam allowance display processing control corresponds to a seam allowance calculation means; S42, S44, and S46, in particular, of the seam allowance display processing control correspond to a movement amount calculation means; S43 and S45, in particular, of the seam allowance display processing control correspond to a moving control means, and the display mode flag F and S31, in particular, of the pattern selection control correspond to a display indication means.

The operation and advantage of the electronic-controlled zigzag sewing machine M will now be described.

In the zigzag sewing machine M, when sewing is performed by aligning the edge of the work cloth with the left end LE or right end RE of the presser foot 7, the distance from the left or right end of the presser foot to a position where stitches are made corresponds to a seam allowance.

The zigzag sewing machine M stores a width Fw and the reference needle penetration position dimension A, which can be changed, for each of type (J, G, A, and R) of presser foot 7, in the width information memory 25A of the flash memory 25. Using the width Fw, the reference needle penetration position dimension A, and needle penetration position P, the zigzag sewing machine M calculates the distance from the left or right of the presser foot to a position where stitches are made, that is, a seam allowance, and displays the seam allowance on the LCD 10.

Therefore, a user can align the edge of the work cloth with the left or right end of the presser foot 7, set a desired seam allowance while seeing the value on the LCD 10, and perform sewing with the desired seam allowance without any difficulty.

So long as the operator desires the seam allowance width be displayed, the seam allowance key is pressed and displayed in an is inverted, or negative, manner, the seam allowance display mode is set, and the seam allowance width displayed in the zigzag width display area 10*b* instead of the zigzag width. Therefore, there is no need to enlarge the LCD 10 to obtain additional space for indicating the seam allowance width.

When the seam allowance is displayed in the zigzag width display area 10*b* along with end mark K1 or K2 indicating the reference position is the right end RE or left end LE of the presser foot 7, the seam allowance can be easily checked via the display, and furthermore, it is easy to understand which edge of the work cloth W should be aligned with which side of the presser foot 7 from the end mark K1 or K2.

The width Fw of the presser foot 7 associated with each type of presser foot is stored in the width information memory 25A so that it can be changed. Once the width Fw is stored for a type of presser foot 7, it does not disappear until it is deleted. If a commercially-available presser foot having a different width Fw is used on the sewing machine, it is possible to easily renew and store the new width Fw.

The actual size display data for the seam allowance may be created to indicate the current seam allowance by the bar K4 showing the actual size instead of a value indication. The actual size indication by the bar K4 will allow the seam allowance width to be easily checked regardless whether the unit of measure in the country of use is centimeters or inches.

The needle plate in the bed 1 may have a reference line in parallel with the feed direction of the work cloth on the top to store information about the width from the reference line to the reference needle penetration position P (0) in the width information memory 25A. The set seam allowance can be easily provided when sewing is performed by aligning the edge of work cloth W with the reference line on the needle plate. Instead of the flash memory 25, a storage medium, such as an EEPROM or a floppy disk which can be rewritten, may be provided. End marks K1 and K2 are not limited to the embodiment, but may be otherwise indicated by various shapes with colors. In this embodiment, an end mark is indicated by a solid line and represents the edge of the presser foot that is a measure of the material edge, and an arrow-head solid line starting from the broken line, representing the seam or stitch line, extends to the solid line. However, this can be modified in a variety of ways. For example, the broken line may be omitted. If a color display is adopted, an element at least of an end mark may be indicated by color. For example, the right end can be indicated by green, center by orange, and left end by red.

The needle bar swinging mechanism can be replaced by the needle bar lateral moving mechanism which is used in the industrial sewing machines and moves the needle bar in a lateral direction perpendicular to the sewing direction.

Although the example shows that the needle position is set only when the straight stitch pattern is selected, the needle position may be set also when the zigzag stitch pattern is selected. In the latter case, the needle position may indicate the alignment line position of the stitch positions when the zigzag stitching is aligned to the left side or the right side. Or, the needle position may indicate the center line position of the stitch positions when the zigzag stitching is not aligned to either side.

The width information memory 25A may store the value of the length from the left end LE or the right end RE of the presser foot 7 to the reference needle penetration position P(0) as the reference needle penetration position dimension A.

The information stored in the width information memory 25A can be used to regulate the irregular setting of the seam allowance width.

Furthermore, when a straight pattern is selected, a seam allowance width may be automatically displayed in the zigzag width display area 10*b*.

Further, in a second embodiment of the invention, when in the zigzag width display mode, when the straight pattern is selected, the value of the distance from the center P(0) to the needle position may be displayed in the area 10*b* on the display. For example, when straight (1) is selected, "−3.5" is displayed. When straight (2) is selected, "0.0" is displayed. If the keys 11*b*, 11*c* are pressed, the value is changed and the needle moves. On the other hand, when the sewing allowance key 2 is highlighted, that is, in the sewing allowance display mode, the same allowance width is displayed the same as the first embodiment. Therefore, the user can move the needle position and confirm the needle position on the display not only in the seam allowance display mode but also in the zigzag width display mode.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. The invention may be further applied to various electronically-controlled sewing machines, such as a lockstitch machine.

What is claimed is:

1. A sewing machine, comprising:

a needle;

a lateral moving mechanism that moves the needle in a lateral direction perpendicular to a sewing direction of a work cloth;

a needle position setting device that sets a needle position within a moving range that the lateral moving mechanism can move the needle;

a positioning device disposed on the sewing machine, the positioning device having a positioning portion to align with an edge of the work cloth; and a width information storing device that stores information on a width between the positioning portion and a predetermined reference position which is determined within the moving range.

2. The sewing machine according to claim 1, wherein the needle position setting device comprises a seam allowance setting device that sets a seam allowance width from the edge of the work cloth to the needle position.

3. The sewing machine according to claim 1, wherein the positioning device comprises a presser foot, and the positioning portion is disposed on at least one of a left end and a right end of the presser foot.

4. The sewing machine according to claim 1, wherein the predetermined reference position is set to a needle penetration position where a moving amount of the needle activated by the lateral moving mechanism is zero.

5. The sewing machine according to claim 2, further comprising:

a needle position supervise device that supervises current needle position information on a current needle position in the lateral direction; and a seam allowance width calculating means that calculates a seam allowance width based on the width information stored in the width information storing device and the current needle position information supervised by the needle position supervise device.

6. The sewing machine according to claim 2, further comprising a movement amount calculating device that calculates a movement amount of the needle in the lateral direction based on a set value of the seam allowance width determined by the seam allowance setting device and a calculated value of the seam allowance determined by the seam allowance width calculating device.

7. The sewing machine according to claim 2, further comprising an informing device that informs an operator of the seam allowance width set by the seam allowance setting device.

8. The sewing machine according to claim 7, wherein the informing device comprises a display, and a display controlling device that controls the display to display the seam allowance width set by the seam allowance setting device.

9. The sewing machine according to claim 8, wherein the display control device controls the display to display the seam allowance width along with a positioning mark indicating the positioning portion.

10. The sewing machine according to claim 8, wherein the display includes a zigzag width display area to display a zigzag width when a zigzag stitch pattern is selected, and the display control device controls the display to display the seam allowance width in the zigzag width display area when a straight stitch pattern is selected.

11. The sewing machine according to claim 10, wherein the display control device controls the display to display selectively one of the zigzag width and the seam allowance width in the zigzag width display area.

12. The sewing machine according to claim 11, further comprising a display mode storing device that stores mode information to distinguish between a zigzag width display mode where the zigzag width is displayed in the zigzag width display area and a seam allowance display mode where the seam allowance is displayed in the zigzag width area.

13. The sewing machine according to claim 8, wherein the display control device controls the display to display the seam allowance width by graphics.

14. The sewing machine according to claim 13, wherein the display control device includes an actual-size display control device that controls the display to display the seam allowance width by a visual image of a bar with an actual size.

15. The sewing machine according to claim 1, wherein the width information storing device stores information on the width of a presser foot in relation to a type of presser foot.

16. The sewing machine according to claim 15, wherein the width information storing device comprises a rewritable and non-volatile storage medium.

17. A sewing machine, comprising:

a needle;

a lateral moving mechanism that moves the needle in a lateral direction perpendicular to a sewing direction of a work cloth; and a positioning device disposed on the sewing machine, the positioning device having a positioning portion to align with an edge of the work cloth; and a seam allowance setting device that sets a seam allowance width from the edge of the work cloth to a needle position within a moving range that the lateral moving mechanism can move the needle.

* * * * *